US007620193B2

(12) United States Patent
Metheringham et al.

(10) Patent No.: US 7,620,193 B2
(45) Date of Patent: Nov. 17, 2009

(54) ACOUSTIC ACTUATORS

(75) Inventors: William John Metheringham, Roos (GB); David Anthony Johnson, Kilnwick (GB); Brian Douglas Smith, London (GB); Neil Munns, Kingston-Upon-Hull (GB); Martin Geoffrey Aston, York (GB)

(73) Assignee: Newlands Technology Limited, Yorkshire (GB)

( * ) Notice: Subject to any disclaimer, the term of this patent is extended or adjusted under 35 U.S.C. 154(b) by 601 days.

(21) Appl. No.: 10/538,441

(22) PCT Filed: Dec. 22, 2003

(86) PCT No.: PCT/GB03/05616

§ 371 (c)(1),
(2), (4) Date: Aug. 8, 2005

(87) PCT Pub. No.: WO2004/057912

PCT Pub. Date: Jul. 8, 2004

(65) Prior Publication Data

US 2006/0050904 A1 Mar. 9, 2006

(30) Foreign Application Priority Data

Dec. 20, 2002 (GB) ..... 0229952.7
Dec. 20, 2002 (GB) ..... 0229954.3

(51) Int. Cl.
*H04R 25/00* (2006.01)

(52) U.S. Cl. ..... 381/190; 381/152

(58) Field of Classification Search ..... 381/152, 381/174, 190, 406, 412, 417, 419; 310/26; 335/278, 279, 296, 298, 299, 302
See application file for complete search history.

(56) References Cited

U.S. PATENT DOCUMENTS

| | | | | |
|---|---|---|---|---|
| 2,031,789 | A | 2/1936 | Pierce | |
| 2,621,260 | A | 12/1952 | Sykes | |
| 3,366,748 | A | 1/1968 | Ashworth | |
| 3,697,790 | A * | 10/1972 | Flint et al. | 381/190 |
| 2001/0005417 | A1 * | 6/2001 | Djahansouzi | 381/174 |

FOREIGN PATENT DOCUMENTS

WO WO 02/076141 9/2002

* cited by examiner

*Primary Examiner*—Brian Ensey
(74) *Attorney, Agent, or Firm*—Jackson Walker, LLP

(57) ABSTRACT

An acoustic transducer comprises an active element which changes in length along a first axis in response to an audiofrequency input signal, the element being mounted between an inertial mass and a foot which in use engages a surface whereby audiofrequency vibrations produced by the active element are transmitted to the surface, characterised in that the foot is hingedly connected to the inertial mass and the active element is located between the foot and the mass such that the angle between the first axis and the surface is less than 90°, in use.

25 Claims, 8 Drawing Sheets

ACOUSTIC ACTUATORS

FIELD OF THE INVENTION

This invention relates to acoustic actuators, for example of the type used to drive panel-type acoustic radiators.

BACKGROUND TO THE INVENTION

Direct drive actuators employing active elements which are rods of magnetostrictive material are well-known. Examples of such actuators are disclosed and claimed in our published International Application WO 02/076141. The method of construction of these actuators means that although they deliver high force they have a physical profile that is unsuitable for some applications. Other active elements such as piezo can be incorporated into actuators that have a flat or narrow profile and may be suitable for many of the applications where a magnetostrictive actuator is unsuitable. However piezo actuators deliver comparatively low forces, require high voltages, about 100v, and are unsuitable for acoustic applications at frequencies below about 1 KHz. For these reasons piezo actuators may not be used. Higher force stacked piezo actuators are available but these are expensive, difficult to manufacture and tend to be unreliable. The height of the stack may also create an unacceptable profile. One potential solution to providing a high force, low profile actuator has been to use a flex-tensional envelope around an active element, as disclosed in USA4845688, that may be a magnetostrictive or piezo engine, but this is still too bulky for many applications.

Conventional axially-arranged actuators typically require an internally-mounted annular spring to provide the pre-tension required to optimise the performance of the active material, for example magnetostrictive material or piezoelectric material. It has been found through experimentation and trial that distortion of the output acoustic signal generated by such a device, particularly when miniaturised, can arise through the annular spring allowing a non-predictable extension to the driven face, resulting in an off-square output force which compromises the audio output.

Audio actuators of different construction produce different frequency bandwidths. Broader bandwidth has been achieved by having a variety of different actuators each driving a surface, or the same surface, separately. This invention describes different methods of combining features of different constructions within a single actuator to achieve broader bandwidth, and consequentially improved audio output, while reducing the overall cost of manufacture and installation. It is also known to combine different materials in a single actuator, for example piezo and magnetostrictive to create a specific output of force and frequency for a particular application.

In a magnetostrictive actuator it is well-known that the design of the coil and size of the magnetostrictive piece of material, amongst other things, influence the frequency response and volume output of the actuator on any surface. It is also well known that actuators can be constructed with a single stack of coils with magnets between the coils in the stack.

SUMMARY OF THE INVENTION

According to a first aspect of the invention there is provided an acoustic transducer comprising an active element which changes in length along a first axis in response to an audiofrequency input signal, the element being mounted between an inertial mass and a foot which in use engages a surface whereby audiofrequency vibrations produced by the active element are transmitted to the surface, characterised in that the foot is hingedly connected to the inertial mass and the active element is located between the foot and the mass such that the angle between the first axis and the surface is less than 90°, in use.

According to this invention the active element of the transducer may be any material that changes length under an external influence and exhibits high forces in so doing. For example this may be a stacked piezo or magnetostrictive element or combination of the two.

In the normally constructed magnetostrictive direct drive actuator the height of the actuator is related to the length of the coil and the magnetostrictive element. In the transverse axis lever actuator using a magnetostrictive active element the overall height of the actuator is related to the cross section of the coil, rather than the length of the coil, and the force is delivered in the direction of the shortest axis of the actuator, perpendicular to the length of the magnetostrictive element or coil, and hence the device is of a considerably lower profile than traditional direct drive axial arrangements. In a stacked piezo actuator the overall height of the actuator is controlled to some degree by the cross-sectional dimension of the piezo stack and the force of actuation of the device is delivered perpendicularly to the direction of displacement. A low profile or lever assisted actuator of this type will be suitable for inclusion in many devices giving improved acoustic frequency bandwidth and volume compared with low profile piezo actuators that may be currently employed, or they may be included in devices to activate a surface when the device is resting on the surface. Examples include personal computers, personal digital assistants, CD and MP3 players and mobile phones.

It has been found that, by introducing a controlling lever hinge of rigid material In one axis, but with the ability to bend in a controlled unpredictable manner in one axis only, either providing a direct drive or a perpendicular all other angle of output, the distortion resulting from the use of an annular spring in conventional transducers can be reduced, improving audio output.

A further advantage is that there is a mechanical advantage effect when the active element works against the inertial mass, resulting in an increase in the dynamic range response of the device. In consequence, a smaller quantity of the active material (which tends to be of high cost) can be used to create high-quality wide range audio output signals.

It has been found, by way of example, that a magnetostrictive actuator manufactured in this way, and measuring 6 mm in the direction of actuating a panel, can produce the equivalent acoustic output of a direct drive magnetostrictive actuator measuring 30 mm, when measured on a test panel, and employs a lower volume of magnetostrictive material. The actuator is more efficient than the direct drive actuator in converting active element displacement into motion of the surface of a panel, with both lower distortion and a wider dynamic range.

According to another aspect of the Invention, there is provided a magnetostrictive actuator, comprising a magnetostrictive element under the influence of at least two stacked electromagnetic coils, each coil in the stack being constructed to have a different frequency response from the other coil or coils in the stack, the coils being excited at the same time, whereby the actuator exhibits a greater frequency bandwidth than if the stacked coils were all of the same specification.

The coils may differ from each other in the number of turns of wire, the thickness of the wire and/or the resistivity of the wire. The signal to each coil may also or alternatively be controlled separately.

Yet another aspect of the invention provides an acoustic actuator for use in Inducing an acoustic signal Into a panel, comprising a first active element which changes in length in response to an audiofrequency Input signal, the element being mounted between an Inertial mass and a foot which in use engages a surface whereby audiofrequency vibrations produced by the active element are transmitted to the surface, characterised by a second active element mounted between the mass and the foot, the second active element having a different frequency response to that of the first active element.

The first active element preferably comprises a magnetostrictive material, while the second active element may also comprise a magnetostrictive material.

The acoustic actuator of this aspect of the invention may also comprise an additional high frequency actuator, for example a moving coil actuator of the type used in traditional loudspeakers.

In another embodiment of the invention, the second active element comprises a flexible yoke arranged such that extension and contraction of the magnetostrictive element causes inward and outward movement of the yoke in a direction transverse to the longitudinal axis of the magnetostrictive element.

Yet another aspect of the invention provides an acoustic actuator for use in inducing an acoustic signal into a primary panel, the actuator comprising a first driver having an active element which changes in length in response to an audiofrequency input signal, the driver being mounted between an inertial mass and a foot which in use engages the panel whereby audiofrequency vibrations produced by the active element are transmitted to the panel, characterised by a second driver coupled to a secondary panel smaller than said primary panel and carried by the second driver.

The first driver is suitably a magnetostrictive device, while the second driver is suitably a high frequency driver such as a moving coil device of the type typically found in conventional loudspeakers.

Preferably, the device comprises a reaction mass having a recess in a first face thereof in which the first driver is located and a second face opposite the first on which the second driver is mounted, a passageway providing communication between the recess and the second face.

It has surprisingly been found that the provision of an open hole or passageway between the interior of the recess and the outer surface of the reaction mass significantly enhances the bass response of the panel loudspeaker of which the device forms a part. A circular passageway having a diameter of around 4 mm has been found to be effective, although other configurations may also be beneficial.

BRIEF DESCRIPTION OF THE DRAWINGS

In the drawings, which illustrate exemplary embodiments of the invention.

DETAILED DESCRIPTION OF THE ILLUSTRATED EMBODIMENTS

Figure 1:
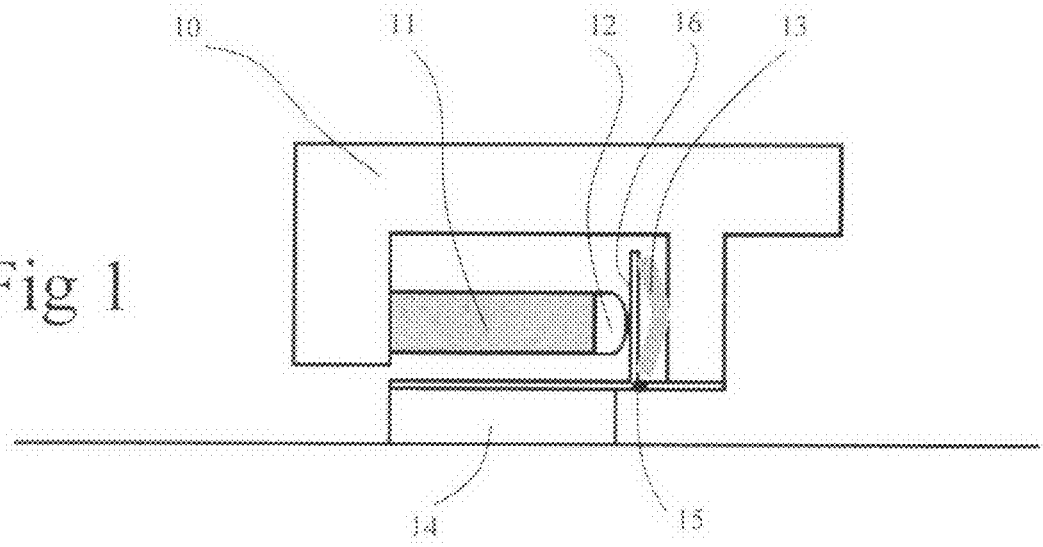
FIG. 1 is a diagrammatic side view of a first embodiment of the invention.

Referring first to FIG. 1, an active element 11 is mounted generally horizontally on an inertial or back mass 10 which is attached to a foot 14 through a resiliently flexible plate 15 acting as a solid-state hinge. A bearing plate 16 extends normally to the hinge and is engaged by a curved bearing surface 12 mounted on the end of the active element 11. A leaf spring 13 is mounted between the bearing plate 16 and the back mass 10 so as to apply controlled pre-tension to the active element. The active element thus drives horizontally, and the construction of the actuator converts this motion into a vertically acting force using the hinge, which is preferably a solid-state hinge to reduce energy losses. A hinge with a pin and/or bearing surface would generate unacceptable losses because of the small amplitude of the movements involved. The curved bearing surface 12 may be part of the element or is more conveniently a separate piece of material of low compliance.

In the case of a magnetostrictive active element, for a given force and cross sectional area of the magnetostrictive rod, the height of the actuator may be further reduced by changing the dimensions of the cross section of the magnetostrictive rod so that it is no longer square or circular but may be rectangular or elliptical and by using an elliptical coil. Further, the force may be increased without increasing the height of the actuator by employing a magnetostrictive rod of greater cross sectional area but maintaining one of the cross sectional dimensions and using an elliptical coil with rectangular or elliptical magnetostrictive material. It will be appreciated that separate coils, one on each side of the magnetostrictive element, may also result in a low profile actuator but the out put will be reduced compared with the output of a single coil wound around a single core of material.

Figure 2:
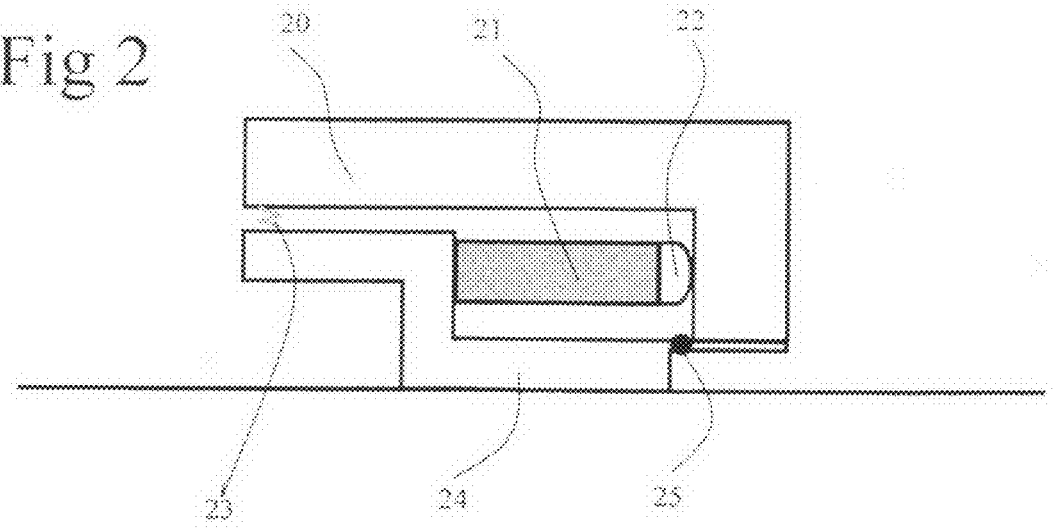
FIG. 2 is a similar view of an alternative embodiment.

In the embodiment shown in FIG. 2, the active element 21 extends between the back mass 20 and an upstand from the foot 24. A helical spring 23 between the upstand and the adjacent part of the back mass controls the pretension on the element 21, which may be secured to the upstand and which engages the back mass through a curved bearing surface 22.

The solid state hinge 15 or 25 is constructed of low compliance material, for example spring steel or a high grade rigid engineering polymer, and to reduce energy losses the ratio between the thickness of the material comprising the hinge and the distance from the pivot point to the point where the hinge material is attached to the foot lever is between certain values.

Figure 3:
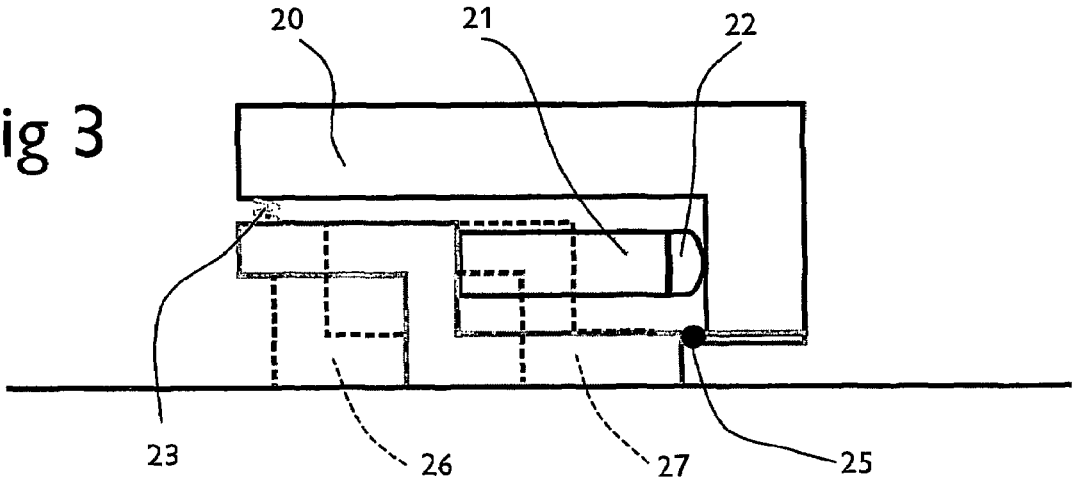
FIG. 3 is a view corresponding to that of FIG. 2, but showing possible modifications.

As a result the actuator has a low profile and can still deliver a high force, only slightly less than a direct drive actuator. Furthermore, the device can be so arranged to deliver variable mechanical amplification and therefore variable force in a more controlled and predictable manner. FIG. 3 illustrates a modification of the device shown in FIG. 2 to illustrate this, and in the Figure like components are indicated by the same reference numerals. Variable mechanical amplification is achieved by moving the contact point 26, 27 between the actuator foot 24 and the surface being driven, towards (as at 27) and away from (as at 26) the pivot point. To optimise the output of the device the position of the back mass 20 also needs to be varied at the same time as the contact point is varied. The mechanical amplification may have a value less than, equal to or greater than 1. The design is scalable, and can be used in a larger format to produce higher powered devices with wide frequency range and lower distortion.

Changing the mechanical amplification of this low profile actuator will change the frequency response of the device to which it is attached. Low mechanical amplification achieved by moving the contact point of the foot towards the pivot point emphasises the higher frequencies and high mechanical amplification achieved by moving the contact point of the foot away from the pivot point emphasises the lower frequencies. In an audio device this means the frequency response can be altered according to the application. For example in public address applications frequencies below 200-300 Hz are undesirable as they make speech harder to understand, but in other applications, such as listening to music, low frequencies are required.

Figure 4:
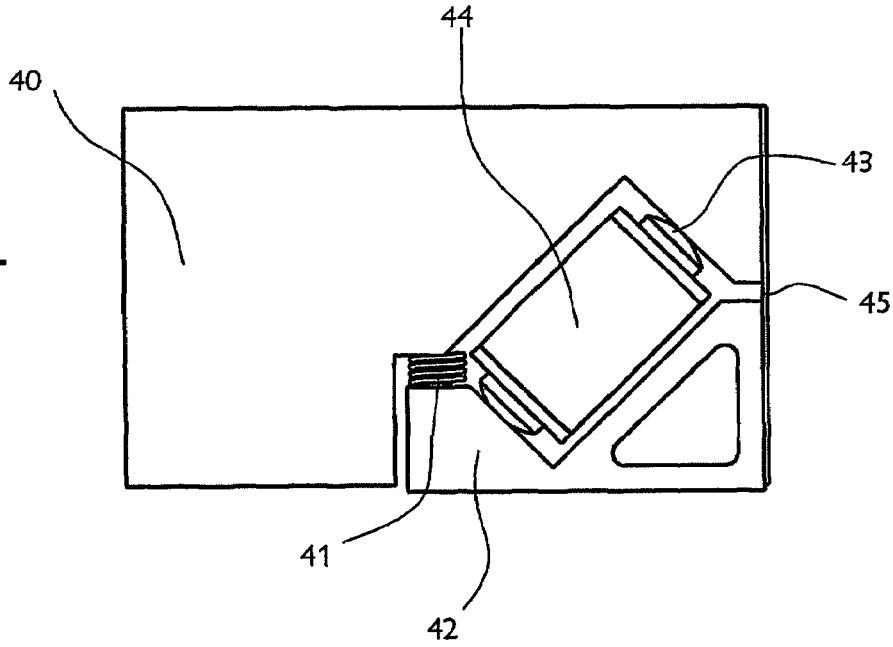
FIGS. 4 and 5 are respectively side elevation and perspective view of another embodiment.
Figure 5:
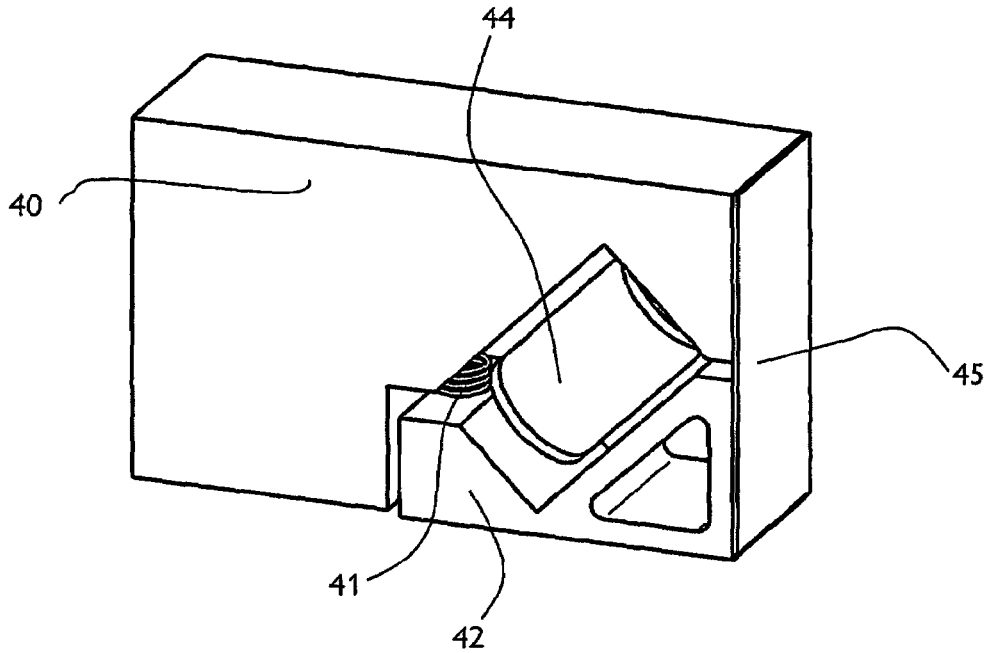

In another embodiment of the invention, the direction of actuation of the drive element may be at any angle to the surface being actuated, for example 45 degrees as shown in FIGS. 4 and 5. In this design the foot 42 is of a low mass. This design behaves ore predictably and has been found to deliver a superior output when compared to an axial direct drive device with the same quantity of active material. The back mass 40 should be mounted as far away from the pivot point 45 as possible so that the effective mass of the back mass is increased as much as possible within the overall envelope of the design, and one of the dimensions of the actuator Is no greater than the cross-section of the active element engine 44 so that the profile of the actuator is suitable for applications where a narrow or low profile is required.

In audio applications it has been found that increasing the back mass 10, 20 or 40, increases the bass response. However if the back mass is arranged according to FIG. 1 the device is less efficient, possibly because of flexure losses, and it has been found that the volume and frequency response is reduced. Arranging the mass according to FIG. 2 or FIG. 3 improves the efficiency and the volume and bass responses.

Figure 6:
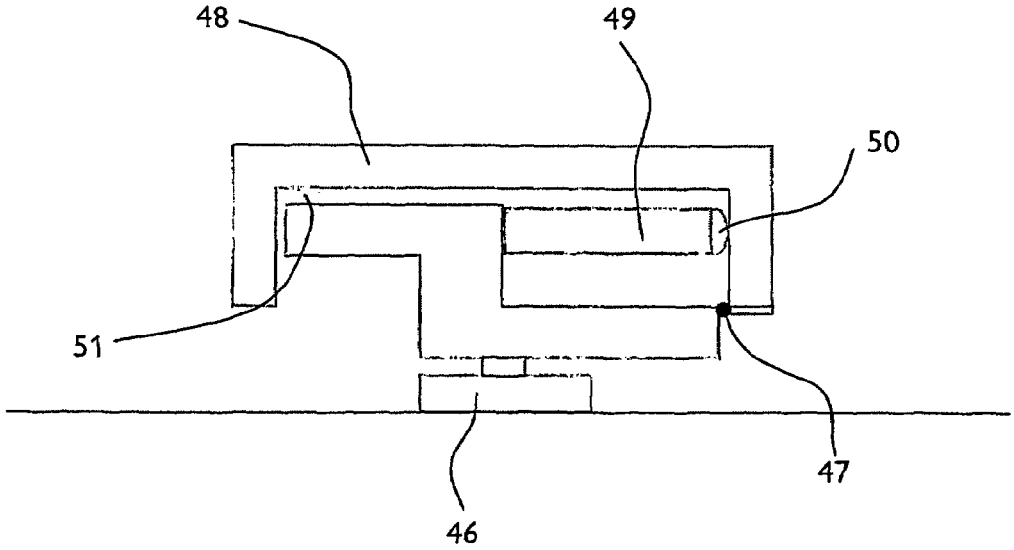
FIG. 6 is a diagrammatic side view of yet another embodiment.

In addition to increasing bass response, increasing the back mass also increases the overall volume level produced by the device. The volume level can be further optimised by placing the foot 46 in the centre of the back mass 48, as may be seen from FIG. 6. Again, the back mass 48 is connected to the foot 46 through a plate hinge 47, but in this embodiment, the foot 46 is an extension from the component which serves this purpose in the earlier embodiments. The active element 49 extends between an upstand on this component and the back mass 48, with the curved bearing surface 50 again providing a non-attached bearing contact with back mass, while a spring 51 again controls the pre-tension on the element 49.

The overall profile and the weight of the device can be cut down by the use of a detachable mass. The back mass required to produce the required volume and bass level may be provided by ancillary components such as batteries, electrical circuitry and the chassis/housing of the device.

The design of the foot is critical for the coupling of the device to the driven surface, and can to a greater or lesser degree affect the volume level and sound quality of the device. Such design features as profile, material and density are all factors which need to be taken into account.

Figure 7:
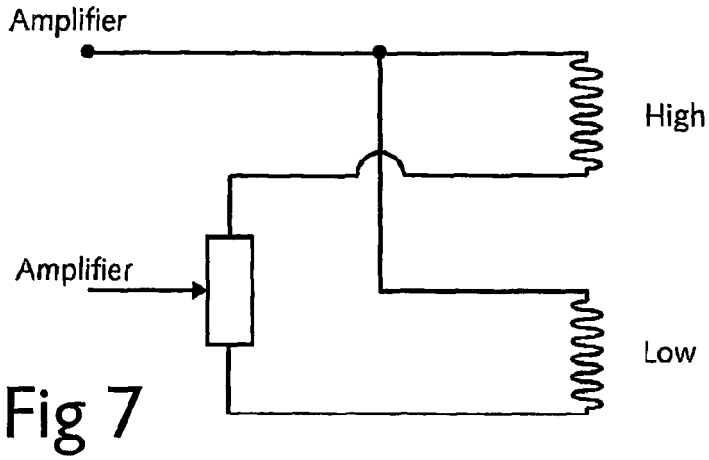
FIGS. 7 to 9 are circuit diagrams illustrating alternative wiring configurations in accordance with another aspect of the invention.
Figure 8:
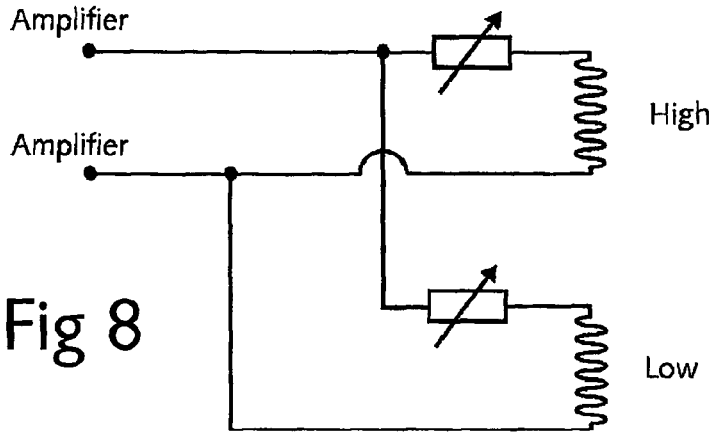
Figure 9:
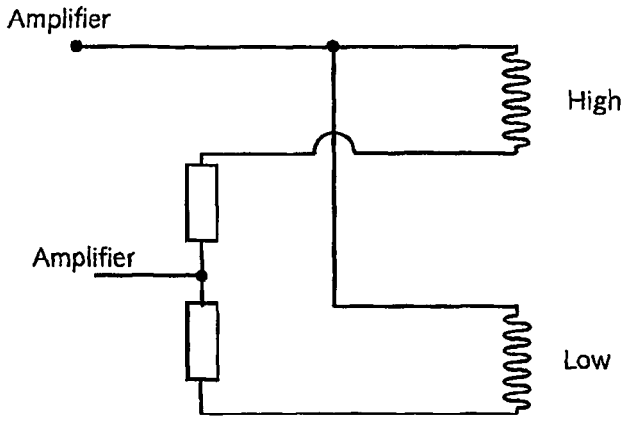

Referring now to FIGS. 7, 8 and 9, the frequency range of a magnetostrictive actuator can be increased by surrounding the magnetostrictive element with two or more coils having different frequency response characteristics. The output of the magnetostrictive actuator can then be varied by a number of means to emphasise different parts of the frequency spectrum according to the output desired. For example a potentiometer can be connected across two coils as shown in FIG. 7 to vary the current to each coil, or potentiometers can be connected to each coil so that instead of changing the balance between the coils, as in FIG. 7, each coil can be varied independently as shown in FIGS. 8 and 9. The setting of the potentiometers may be fixed at manufacture or may be variable so that it is accessible to the user and would be used in the same way as a tone control in a conventional amplifier/speaker arrangement.

The coils may be wound on separate bobbins or wound on the same bobbin. If wound on the same bobbin they may be coaxially wound, or wound in separate layers or at different ends of the bobbin.

Another variable that can be used to change the frequency response of an actuator is to vary the dimensions of the magnetostrictive material or to vary the composition of the magnetostrictive material, and to have different dimensions of material, or different magnetostrictive materials as well as different coils in each part of a combined actuator. The coils and drive elements may be configured side by side as in FIG. 13, or stacked on top of one another in the more usual arrangement.

Figure 10:
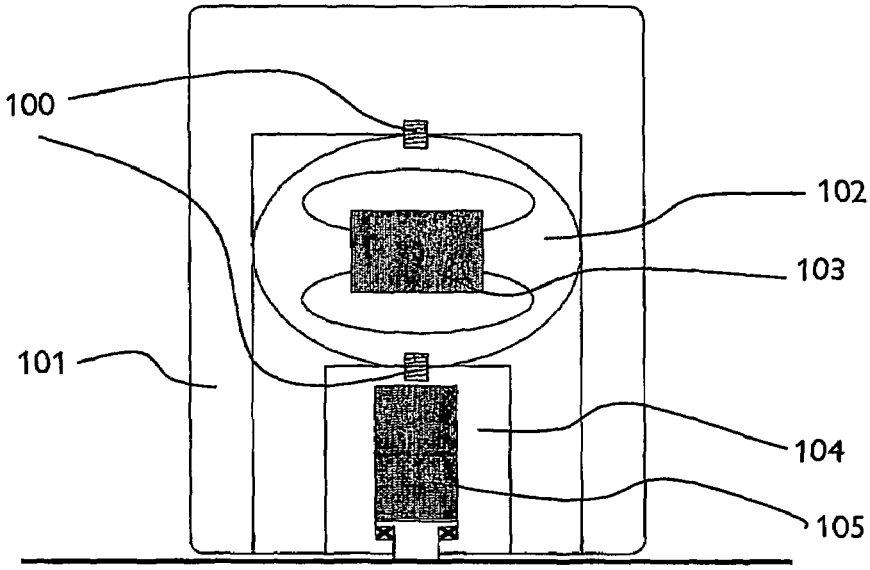
FIG. 10 is a diagrammatic side view of an actuator according to a further aspect of the invention.
Figure 11:
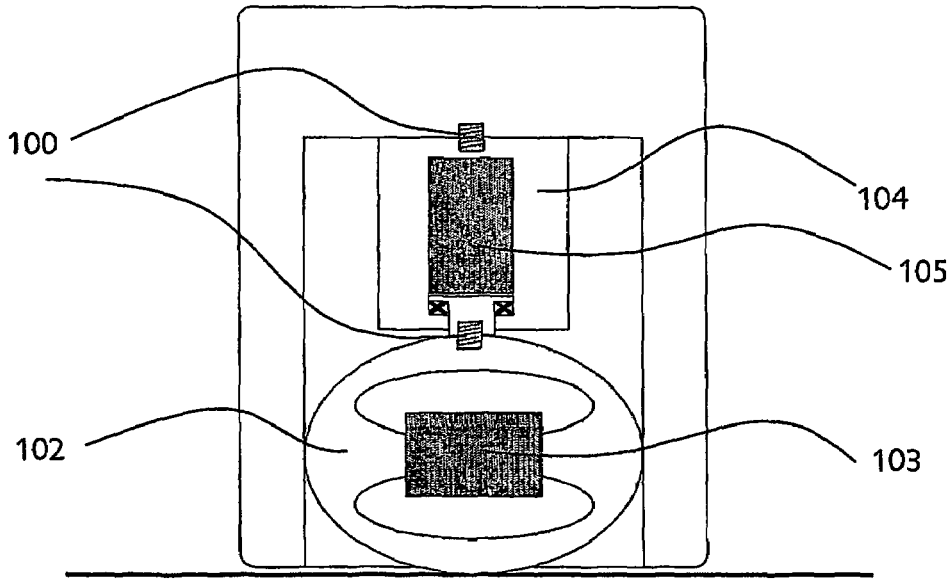
FIGS. 11 to 15 show alternative embodiments to the actuator shown in FIG. 10.
Figure 12:
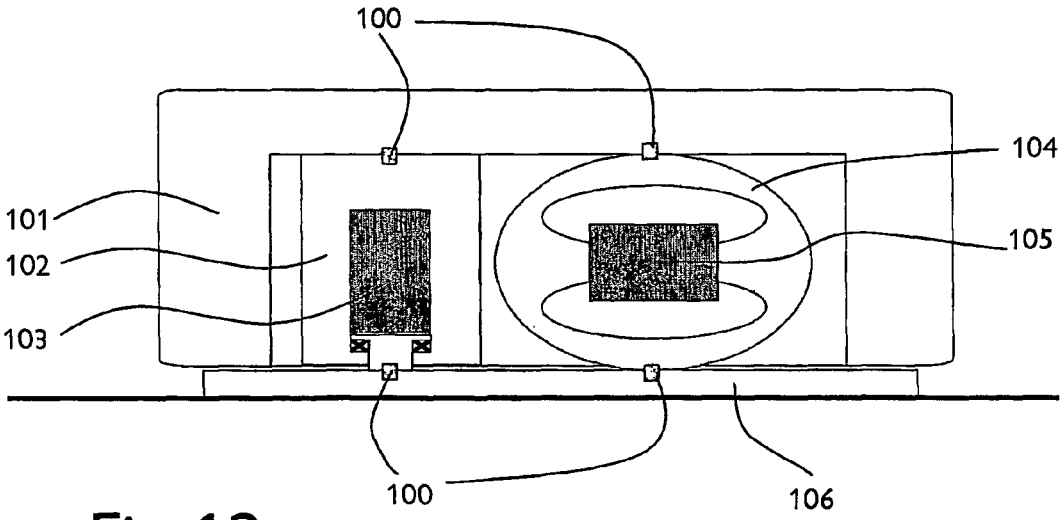

Another variable is to have a combined flextensional and direct drive actuator as illustrated in FIGS. 10, 11 and 12, with the coils and dimensions of the magnetostrictive materials being chosen according to the output desired. It has been found that the configuration in FIG. 10 is most advantageous, but in another configuration, shown in FIG. 11, the direct drive element could be on top of the flextensional drive element, or the drive elements could be side by side, as shown in FIG. 12. Referring in detail first to FIG. 10, the actuator comprises a conventional magnetostrictive actuator consisting of a body 104 containing a driver 105 comprising a magnetostrictive element surrounded by electromagnetic coils and with permanent magnets to provide initial biasing, and with a spring to provide pre-tensioning of the element. The flextensional element consists of a resiliently deformable yoke 102 having a central split portion into which a magnetostrictive driver 103 is mounted in such a manner that elongation of the magnetostrictive element pushes the two parts of the split central portion outwardly. The yoke also has two outer arms linked to the central portion such that longitudinal deformation of the central portion causes inward and outward movement of the outer arms in a direction transverse to the axis of elongation of the magnetostrictive element. The two active elements 103 and 105 are mounted within a housing 101 which forms a back mass for the device, a connection being established by screws 100, so that, in the case of the embodiment illustrated in FIG. 10, the outer arms of the yoke 102 are attached to the housing 101 and to the body 104 of the direct drive actuator, so that the combined effect of the two actuators is coupled Into the surface on which the device is located. Alternative arrangements are illustrated by FIGS. 11 and 12. In FIG. 11, the positions of the direct drive and flextensional actuators are simply reversed vertically, while in the embodiment of FIG. 12, the two actuators are mounted side-by-side in a wider housing 101 via screwed attachments 100, and are also attached via screws 100 at their lowermost sides to a separate foot 106.

Figure 13:
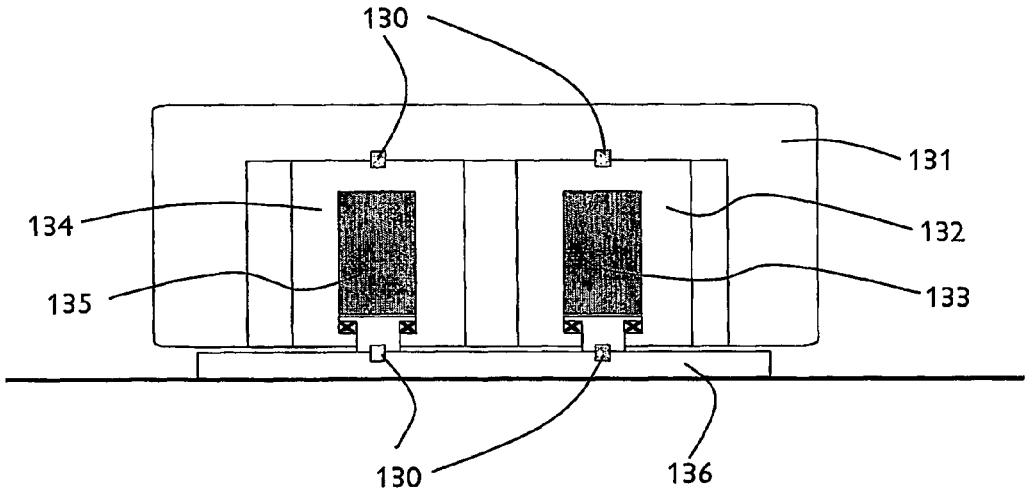

FIG. 13 illustrates a further alternative embodiment, in which two direct drive actuators 132 and 134, each containing a respective magnetostrictive driver 133 and 135 and constructed and configured to have different frequency responses, are mounted side-by-side between a housing 131 and a common foot 136, again using screwed connections for transmission of audio frequency vibrations.

Figure 14:
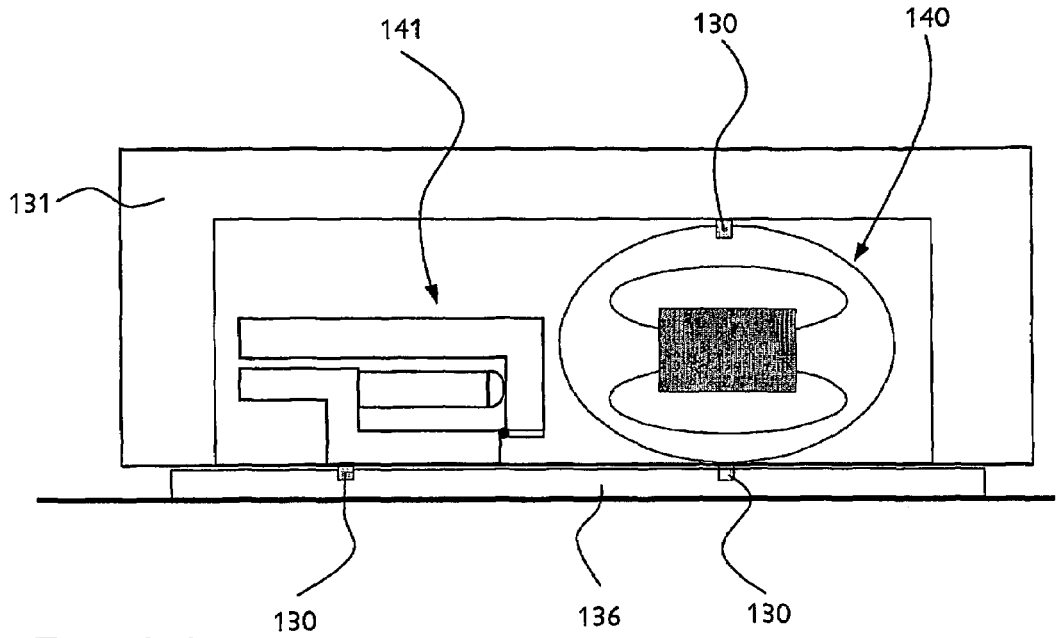
Figure 15:
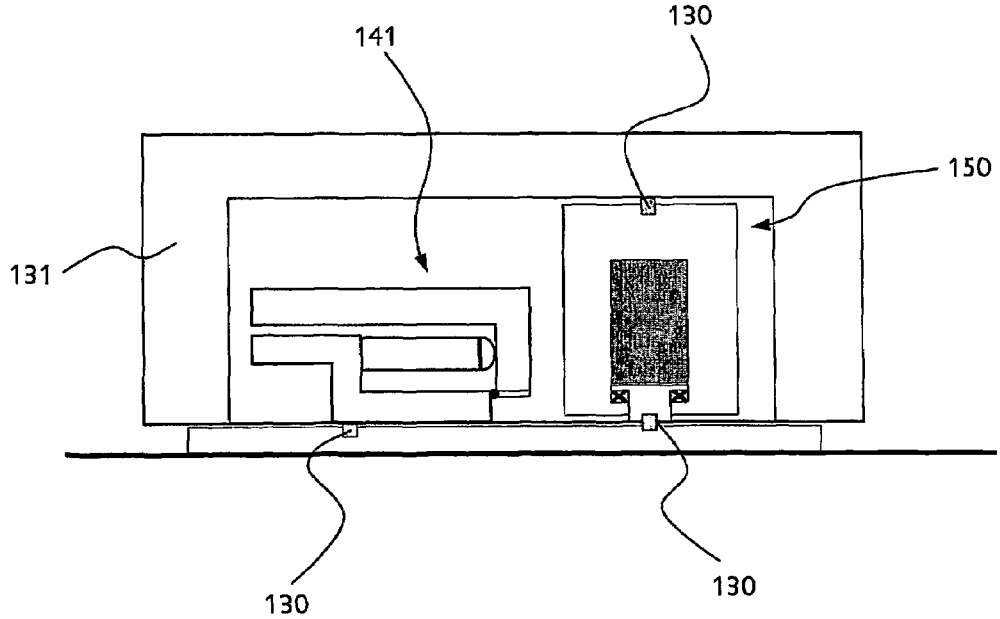

A further variation is illustrated in FIGS. 14 and 15, in which one of the actuators is a transverse lever actuator in accordance with the first aspect of the invention, in conjunction with another type of actuator of different frequency response. In the embodiment of FIG. 14, the device contains a flextensional actuator 140 as described herein with reference to FIG. 10, mounted between the housing 131 and the separate foot 136 by screws 130. The foot 136 also mounts a lever actuator 141 of the type described herein with reference to FIG. 2, attached to the foot by one or more screws 130. In the embodiment of FIG. 15, the flextensional actuator 140 is replaced by a direct drive actuator 150.

Figure 16:
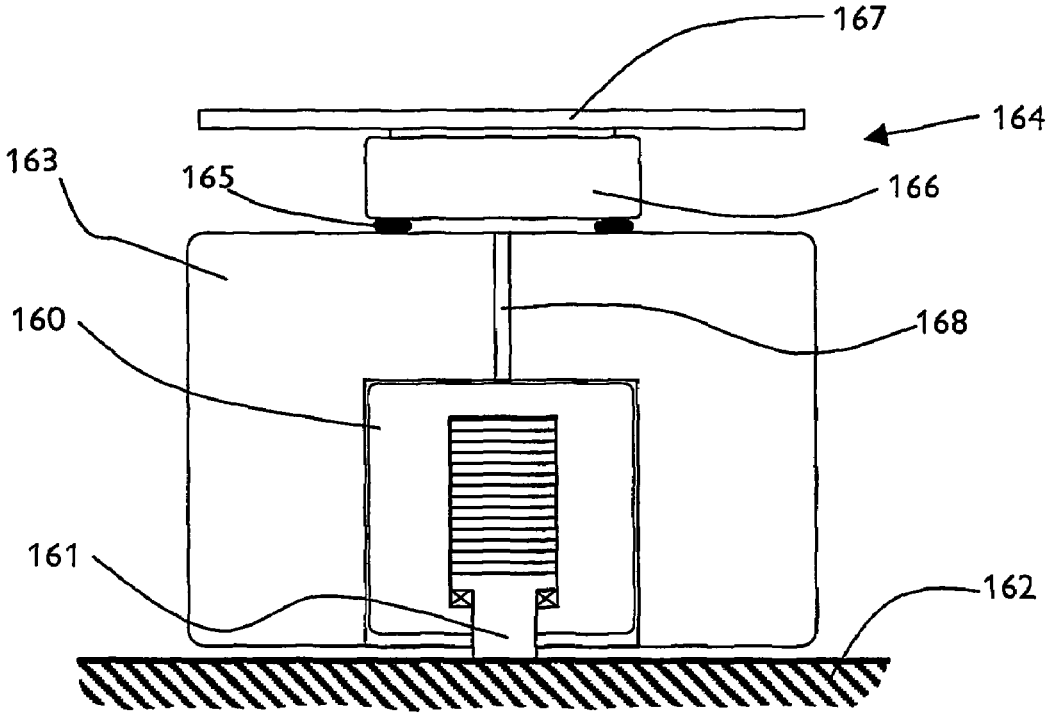
FIG. 16 is a diagrammatic side view of a loudspeaker arrangement according to yet another aspect of the invention.

FIG. 16 illustrates a device according to another aspect of the invention, in which a traditional speaker moving coil driver is added to a magnetostrictive device to improve the high frequency response in much the same way that a tweeter is used in a conventional loudspeaker system. The device comprises a generally conventional magnetostrictive audio actuator 160 having a foot 161 which engages the surface of a panel 162 into which it induces acoustic waves so that the panel radiates sound in response to the audio signal supplied to the device. The actuator 160 is mounted in a recess in the lower face of a reaction mass 163, and a high frequency driver unit 164 is mounted on opposite face of the mass 163 via resilient mountings 165 which serve to reduce mechanical transfer of vibrations between the two devices. The high frequency driver unit 164 comprises a moving coil driver 166 of the type typically used in conventional loudspeakers, coupled to a light weight panel 167, for example formed of a rigid low-density board. A hole 168 is provided in the reaction mass 163 extending between the interior of the recess and the surface on which the driver unit 164 is mounted. It has surprisingly been found that the provision of this open hole or passageway 168 significantly enhances the bass response of the panel loudspeaker of which the device forms a part. The hole also serves the secondary rôle of providing a route for the electrical connection between the moving coil driver 166 and the magnetostrictive actuator 160.

A two-unit actuator could have controls, for example bass and treble, and a three-unit actuator controls for bass, mid-range and treble. These controls may be integral to the device or contained in external crossover circuitry to split the input signal to distribute the frequency only to the selected active element of the assembly. Further combinations and numbers of separate units within the same actuator are possible.

The invention claimed is:

1. An acoustic transducer adapted to co-operate with a surface to induce into the surface audiofrequency vibrations whereby the surface radiates sound therefrom, the transducer comprising an active element which changes in length along a first axis in response to an audiofrequency input signal, the element being mounted between an inertial mass and a foot which engages a surface whereby audiofrequency vibrations produced by the active element are acoustically coupled into the surface, wherein the foot is hingedly connected to the inertial mass and the active element is located between the foot and the mass such that the angle between the first axis and the surface is less than 90°, and the connection between the inertial mass and the foot comprises a resiliently flexible material.

2. An acoustic transducer according to claim 1, wherein the said angle is 45° or less.

3. An acoustic transducer according to claim 1, wherein the first axis extends substantially parallel to the surface.

4. An acoustic transducer according to claim 1, wherein the connection between the inertial mass and the foot comprises a resiliently flexible material.

5. An acoustic transducer according to claim 1, wherein the resiliently flexible material is a low compliance material.

6. An acoustic transducer according to claim 1, wherein said material is spring steel.

7. An acoustic transducer according to claim 1, wherein the centre of the foot is directly below the centre of gravity of the transducer.

8. An acoustic transducer according to claim 1, wherein the inertial mass includes one or more of batteries, electrical circuitry, and a housing for the transducer.

9. An acoustic transducer according to claim 1, wherein the active element comprises a magnetostrictive material.

10. An acoustic transducer according to claim 1, wherein the active element comprises a piezoelectric material.

11. An acoustic transducer adapted to co-operate with a surface to induce into the surface audiofrequency vibrations whereby the surface radiates sound therefrom, the transducer comprising an active element which changes in length along a first axis in response to an audiofrequency input signal, the element being mounted between an inertial mass and a foot which engages a surface whereby audiofrequency vibrations produced by the active element are acoustically coupled into the surface, wherein the foot is hingedly connected to the inertial mass and the active element is located between the foot and the mass such that the angle between the first axis and the surface is less than 90°, wherein the centre of the foot is directly below the centre of gravity of the transducer.

12. An acoustic transducer according to claim 11, wherein the said angle is 45° or less.

13. An acoustic transducer according to claim 11, wherein the first axis extends substantially parallel to the surface.

14. An acoustic transducer according to claim 11, wherein the active element comprises a magnetostrictive material.

15. An acoustic transducer according to claim 11, wherein the active element comprises a piezoelectric material.

16. An acoustic transducer adapted to co-operate with a surface to induce into the surface audiofrequency vibrations whereby the surface radiates sound therefrom, the transducer comprising an active element which changes in length along a first axis in response to an audiofrequency input signal, the element being mounted between an inertial mass and a foot which in use engages a surface whereby audiofrequency vibrations produced by the active element are acoustically coupled into the surface, wherein the foot is hingedly connected to the inertial mass and the active element is located between the foot and the mass such that the angle between the first axis and the surface is less than 90°, wherein the inertial mass includes one or more of batteries, electrical circuitry, and a housing for the transducer.

17. An acoustic transducer according to claim 16, wherein the said angle is 45° or less.

18. An acoustic transducer according to claim 17, wherein the first axis extends substantially parallel to the surface.

19. An acoustic transducer according to claim 16, wherein the active element comprises a magnetostrictive material.

20. An acoustic transducer according to claim 16, wherein the active element comprises a piezoelectric material.

21. An acoustic transducer adapted to be located against a surface to induce audiofrequency vibrations into said surface whereby said surface radiates sound therefrom, the transducer comprising an active element which changes in length along a first axis in response to an audiofrequency input signal, the element being mounted between an inertial mass and a foot which engages a surface whereby audiofrequency vibrations produced by the active element are acoustically coupled into the surface, wherein the foot is hingedly connected to the inertial mass and the active element is located between the foot and the mass such that the angle between the first axis and the surface is less than 90°.

22. An acoustic transducer according to claim 21, wherein the said angle is 45° or less.

23. An acoustic transducer according to claim 22, wherein the first axis extends substantially parallel to the surface.

24. An acoustic transducer according to claim 21, wherein the active element comprises a magnetostrictive material.

25. An acoustic transducer according to claim 21, wherein the active element comprises a piezoelectric material.

* * * * *

UNITED STATES PATENT AND TRADEMARK OFFICE

CERTIFICATE OF CORRECTION

PATENT NO. : 7,620,193 B2
APPLICATION NO. : 10/538441
DATED : November 17, 2009
INVENTOR(S) : Metheringham et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1061 days.

Signed and Sealed this

Twenty-sixth Day of October, 2010

David J. Kappos

David J. Kappos
*Director of the United States Patent and Trademark Office*